US007536302B2

(12) United States Patent
Chen et al.

(10) Patent No.: US 7,536,302 B2
(45) Date of Patent: May 19, 2009

(54) METHOD, PROCESS AND DEVICE FOR CODING AUDIO SIGNALS

(75) Inventors: Fang-Chu Chen, Taipei (TW); Te-Ming Chiu, Tao-Yuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 818 days.

(21) Appl. No.: 10/889,019

(22) Filed: Jul. 13, 2004

(65) Prior Publication Data

US 2006/0015332 A1 Jan. 19, 2006

(51) Int. Cl.
*G10L 19/00* (2006.01)

(52) U.S. Cl. ..... 704/230; 200/500; 200/501

(58) Field of Classification Search ..... 704/200.1, 704/230, 500, 501
See application file for complete search history.

(56) References Cited

U.S. PATENT DOCUMENTS 5,680,130 A * 10/1997 Tsutsui et al. ..... 341/87
5,734,657 A * 3/1998 Kim ..... 370/437
5,734,792 A * 3/1998 Teh ..... 704/230
5,812,982 A * 9/1998 Chinen ..... 704/229
5,890,125 A * 3/1999 Davis et al. ..... 704/501
5,924,064 A * 7/1999 Helf ..... 704/229
6,016,111 A * 1/2000 Park et al. ..... 341/55
6,081,784 A * 6/2000 Tsutsui ..... 704/501
6,148,288 A * 11/2000 Park ..... 704/500
6,438,525 B1 * 8/2002 Park ..... 704/500
6,446,037 B1 * 9/2002 Fielder et al. ..... 704/229
6,529,604 B1 * 3/2003 Park et al. ..... 381/22
6,611,798 B2 * 8/2003 Bruhn et al. ..... 704/219
7,243,061 B2 * 7/2007 Norimatsu et al. ..... 704/205
7,272,567 B2 * 9/2007 Fejzo ..... 704/500
7,318,023 B2 * 1/2008 Baum ..... 704/206
2003/0212551 A1 * 11/2003 Rose et al. ..... 704/230
2004/0181395 A1 * 9/2004 Kim et al. ..... 704/200.1
2005/0010396 A1 * 1/2005 Chiu et al. ..... 704/200.1
2005/0231396 A1 * 10/2005 Dunn ..... 341/50
2005/0252361 A1 * 11/2005 Oshikiri ..... 84/605
2007/0071089 A1 * 3/2007 Kim et al. ..... 375/240.1

* cited by examiner

*Primary Examiner*—Patrick N Edouard
*Assistant Examiner*—Douglas C Godbold
(74) *Attorney, Agent, or Firm*—Alston & Bird LLP

(57) ABSTRACT

A method and a device for audio coding are disclosed. An audio coding device includes an audio coder for receiving audio signals and generating base data and enhancement data; and a rearranging device coupled to the audio coder. The rearranging device rearranges the enhancement data according to sectional factors of spectral sections to allow output data to be generated from rearranged enhancement data. The base data contain data capable of being decoded to generate a portion of the audio signals, and the enhancement data cover at least two spectral sections of data representative of a residual portion of the audio signals.

17 Claims, 9 Drawing Sheets

METHOD, PROCESS AND DEVICE FOR CODING AUDIO SIGNALS

RELATED APPLICATION

The present application is related to co-pending application Ser. No. 10/714,617, entitled "SCALE FACTOR BASED BIT SHIFTING IN FINE GRANULARITY SCALABILITY AUDIO CODING" and filed on Nov. 18, 2003, which claims priority to provisional application Ser. No. 60/485,161, filed Jul. 8, 2003.

BACKGROUND

1. Field of the Invention

The present invention generally relates to audio coding. More particularly, the present invention relates to a device and a method for scalable audio coding.

2. Background of the Invention

Multimedia streaming provides real-time video and audio services over a communication network, and in the last decade has become one of the primary tools for transmitting video and audio signals. Various aspects of multimedia streaming have become the focus of research and product development. One aspect is the capability of adjusting, in real time, the content or amount of multimedia data according to channel conditions, such as channel traffic or bit rate available for transmitting data over one or more communication channels. In particular, because the channel bandwidth available for transmitting multimedia data may vary over time, the content or the amount of the data transmitted may be adjusted over time accordingly to accommodate bandwidth variations, maximize the use of bandwidth, and/or minimize the impact of limited bandwidth. However, traditional coding methods are typically designed for transmitting data at a fixed bit rate and may frequently be impacted by bandwidth variations.

Fine Granularity Scalability ("FGS") coding is a coding method allowing the transmission bit rate to vary over time. The concept of FGS makes a set of data, or at least part of that data, "scalable," which means that data may be transmitted with varied length or in discrete portions without affecting a receiver's ability to decode the data. Due to the limitations of fixed bit-rate coding noted above and the scalability of FGS, it has become a popular option for real-time streaming applications. In particular, the Motion Picture Experts Group ("MPEG") has adopted FGS coding and incorporated it into the MPEG-4 standard, a standard covering audio coding and decoding.

Another coding technique, scalable video coding, has recently been proposed to provide FGS features. For example, a Scalable Lossless ("SLS") coder, which uses FGS coding approaches, has been proposed to be incorporated into MPEG standards.

However, current coding approaches, such as those of SLS coders, may be limited in accommodating bit-rate variations or low bit-rate availabilities. The quality improvement derived from employing additionally available bandwidth may be, under some circumstances, limited. There is therefore a need for improved coding techniques.

SUMMARY OF THE INVENTION

An audio coding method consistent with the present invention includes receiving audio signals; processing the audio signals to generate base data and enhancement data; and rearranging the enhancement data according to sectional factors associated with spectral sections of the enhancement data to allow output data to be generated from rearranged enhancement data. In one embodiment, the base data contain data capable of being decoded to generate a portion of the audio signals, and the enhancement data cover at least two spectral sections of data representative of a residual portion of the audio signals.

A bit rearranging process for audio coding consistent with the present invention includes receiving base data and enhancement data representative of audio signals; calculating zero-line ratios of the base data of spectral sections; and rearranging enhancement data by up-shifting a section of the enhancement data by at least one plane if a corresponding zero-line ratio is higher than or equal to a prescribed ratio bound. In one embodiment, the base data contain data capable of being decoded to generate a portion of the audio signals, and the enhancement data cover at least two spectral sections of data representative of a residual portion of the audio signals. In addition, a zero-line ratio of a section is the ratio of the number of spectral lines with zero quantized value to the number of spectral lines in that section in the base data.

A method of determining band significance of enhancement data derived from audio signals consistent with the present invention includes calculating zero-line ratios of bands of base data derived from the audio signals and deriving a band significance of the band of the enhancement data according to the corresponding zero-line ratios of the associated bands. In particular, a zero-line ratio of a band being the ratio of the number of lines with zero quantized value to the number of lines in that band in the base data.

An audio coding device consistent with the present invention includes an audio coder for receiving audio signals and generating base data and enhancement data; and a rearranging device coupled to the audio coder. The rearranging device rearranges the enhancement data according to sectional factors of spectral sections to allow output data to be generated from rearranged enhancement data. In one embodiment, the base data contain data capable of being decoded to generate a portion of the audio signals, and the enhancement data cover at least two spectral sections of data representative of a residual portion of the audio signals.

These and other elements of the present invention will be more fully understood upon reading the following detailed description in conjunction with the accompanying drawings.

DESCRIPTION OF EMBODIMENTS

Reference will now be made in detail to embodiments of the invention, examples of which are illustrated in the accompanying drawings.

Embodiments consistent with the present invention may process enhancement data, such as an enhancement layer, received from an audio coder. An example of the enhancement layer may include an Advanced Audio Coding ("AAC") bitstream received from an AAC coder. In embodiments consistent with the present invention, audio data of spectral sections, bands, or lines having more significance or providing better acoustic effects may take priority in their coding sequence. For example, spectral lines with zero quantization values or bands with one or more lines having zero quantization values in base data or a base layer may have their corresponding enhancement data coded first. In other words, a portion or all of the residual data for those spectral sections, bands, or lines may be sent before the residual data of others spectral sections, bands, or lines are sent. As an example, an enhancement data reordering or rearranging process may be performed before bit-slicing the enhancement data in one of the embodiments. In embodiments consistent with the present invention, the approach may provide a better FGS (fine granular scalability) to the enhancement data.

Figure 1:
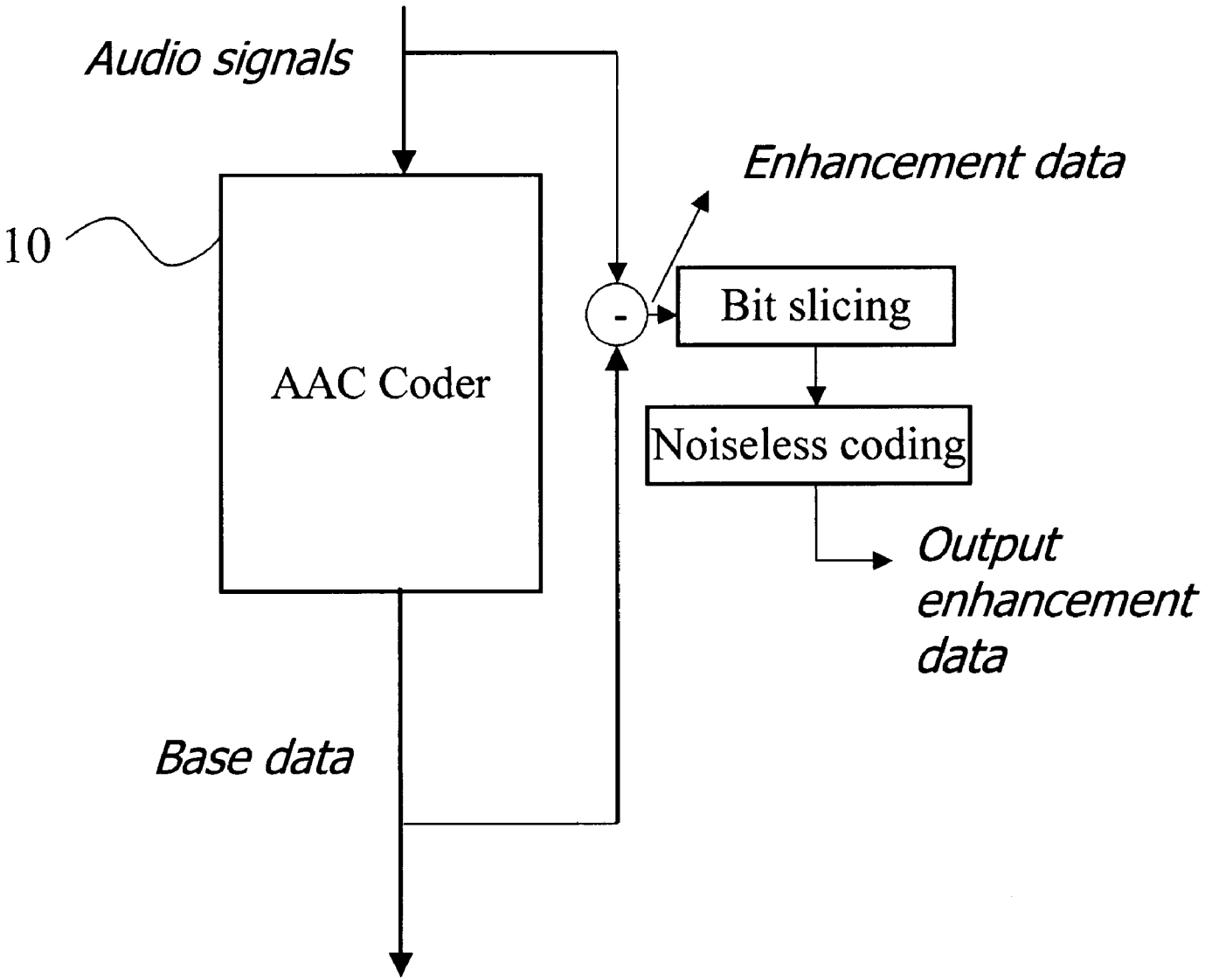
FIG. 1 is a schematic block diagram of an audio coding device in embodiments consistent with the present invention.

To prepare audio signals for transmission through a communication network, an audio coding may process the audio signals to generate streamlined data. FIG. 1 shows a schematic block diagram of an audio coding device in embodiments consistent with the present invention. In one embodiment, the audio coding device may employ an FGS coding process. The process may generate from audio signals base data and enhancement data, one or both of which may be supplied for data transmissions. In one embodiment, AAC coder 10 may generate base data from a portion of the audio signals, and may generate enhancement data from part or all of the residual portion of the audio signals. As an example, U.S. Pat. No. 6,529,604 to Park et al. discloses one way of generating one form of base data. In particular, it describes an example of a scalable audio coding apparatus that generates a basic bitstream from audio signals. After the base data is generated, the enhancement data may be generated by subtracting the base data from the audio signals in one embodiment. As shown in FIG. 1, the enhancement data may go through bit-slicing and noiseless coding to generate output data.

Figure 2:
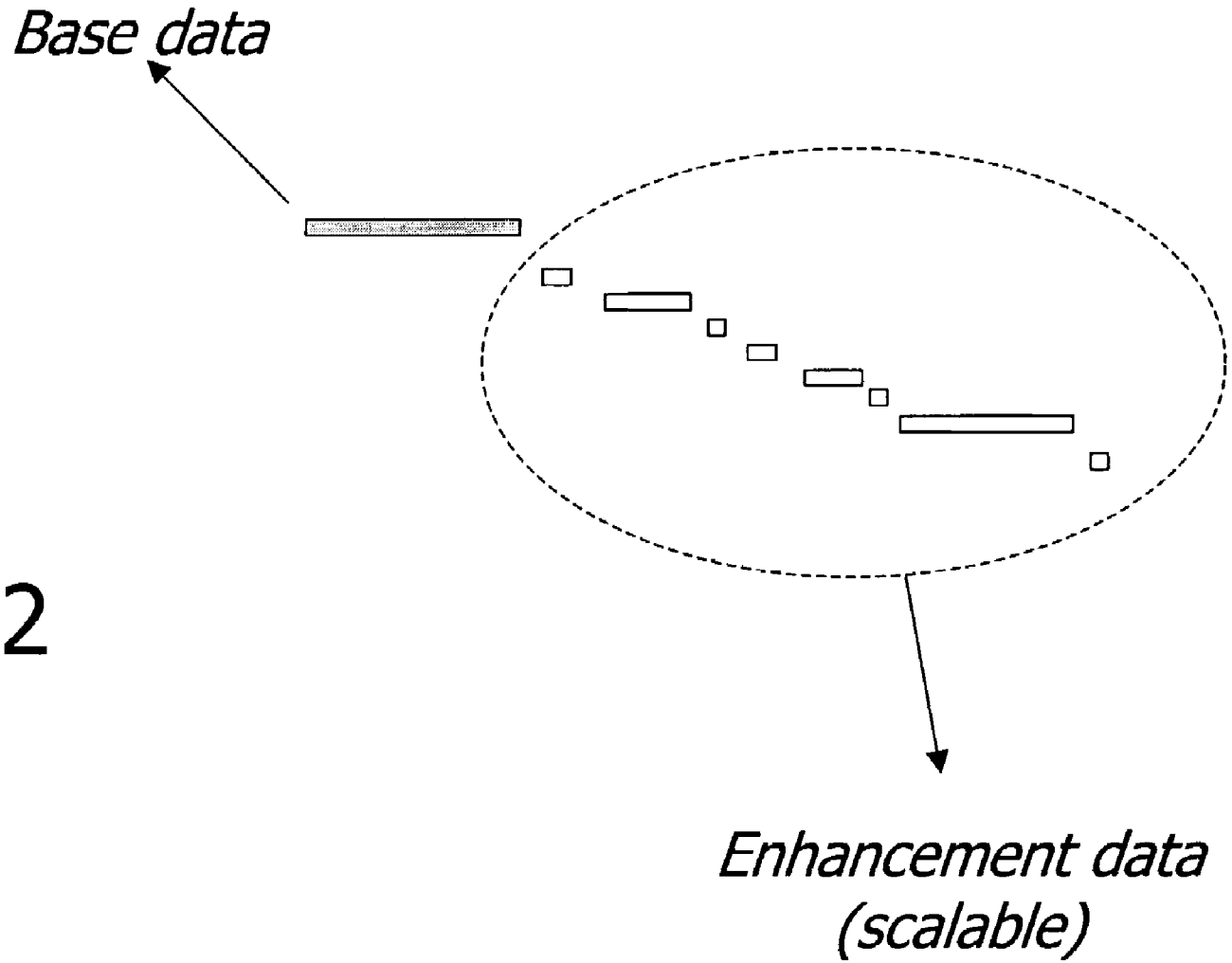
FIG. 2 is a schematic diagram illustrating the relationship between base data and enhancement data in embodiments consistent with the present invention.

FIG. 2 depicts a schematic diagram illustrating the relationship between base data and enhancement data in embodiments consistent with the present invention. In one embodiment, the base data may be a base layer consistent with FGS coding under the MPEG-4 standard, and, similarly, the enhancement data may be an enhancement layer consistent with FGS coding under the MPEG-4 standard. In particular, both may be generated using a scalable coding technique or an SLS (scalable lossless) coder in one embodiment.

Referring again to FIG. 2, we may consider the base data as having the data of a portion of the audio signals, or core audio data, for a listener to receive basic or intelligible audio information after the base data is received and decoded. Also, we may consider the enhancement data as having additional audio data or data representative of at least a part of the residual portion of the audio signals. Part or all of the enhancement data may be decoded and combined with the information decoded from the base data to enhance a listener's experience with the audio information decoded.

As shown in FIG. 2, the enhancement data may be scalable, which means that a decoder can decode one or more discrete portions of the enhancement data, but need not receive the enhancement data in its entirety for decoding or enhancing audio quality. This is particularly useful for transmissions with varying bit-rates, because truncation of the quantized data may take place as data or layer size limits are applied to the enhancement data. For example, portions of the enhancement data may be transmitted to improve audio quality whenever the bandwidth or bit rate of a channel allows such transmission. Therefore, in one embodiment, the base data may be representative of a major portion of audio signals, and the enhancement data may be scalable and representative of two or more sections of data representative of one or more residual portions of the audio signals.

Figure 3:
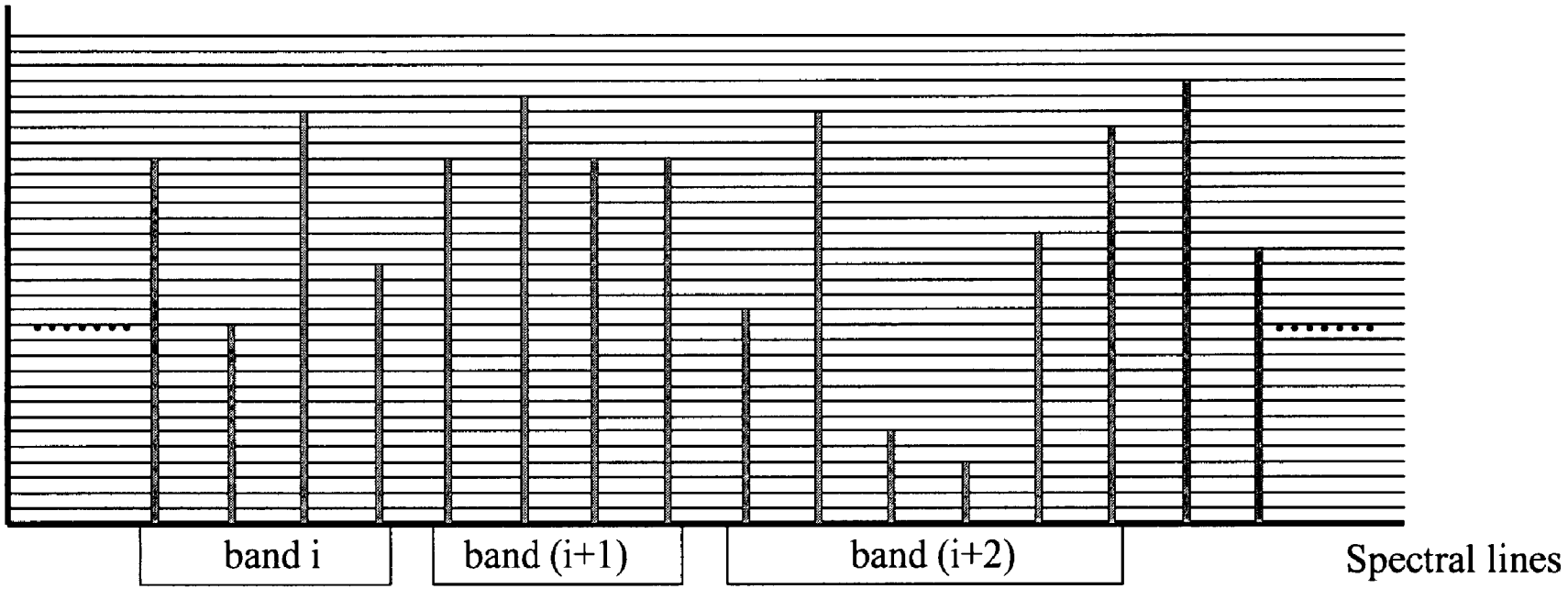
FIG. 3 is a schematic bar chart illustrating exemplary compositions of base data or enhancement data in embodiments consistent with the present invention.

Each of the enhancement data and the base data may organize its data in sections representing separable parts of audio signals, such as audio data at separate frequencies. In one embodiment, sections may be spectral bands, sub-bands, lines, or their combinations. FIG. 3 shows a schematic bar chart illustrating exemplary compositions of base data or enhancement data in embodiments consistent with the present invention. FIG. 3 shows a portion of base data or enhancement data, wherein a section may comprise band i, which may include a number of spectral lines, such as four lines. The height of each line may represent the data, or sound level, at a corresponding frequency.

Accordingly, a set of base data or enhancement data, which contain data representative of levels at separate spectral sections, bands, sub-bands, or lines, may represent a portion of audio signal at a particular time. In addition, the sections may be scalefactor bands or sub-bands in one embodiment, which assigns scale factors to some or all bands or sub-bands during a coding process to reflect, emphasize, or de-emphasize the significance or acoustic effect of those bands.

Figure 4:
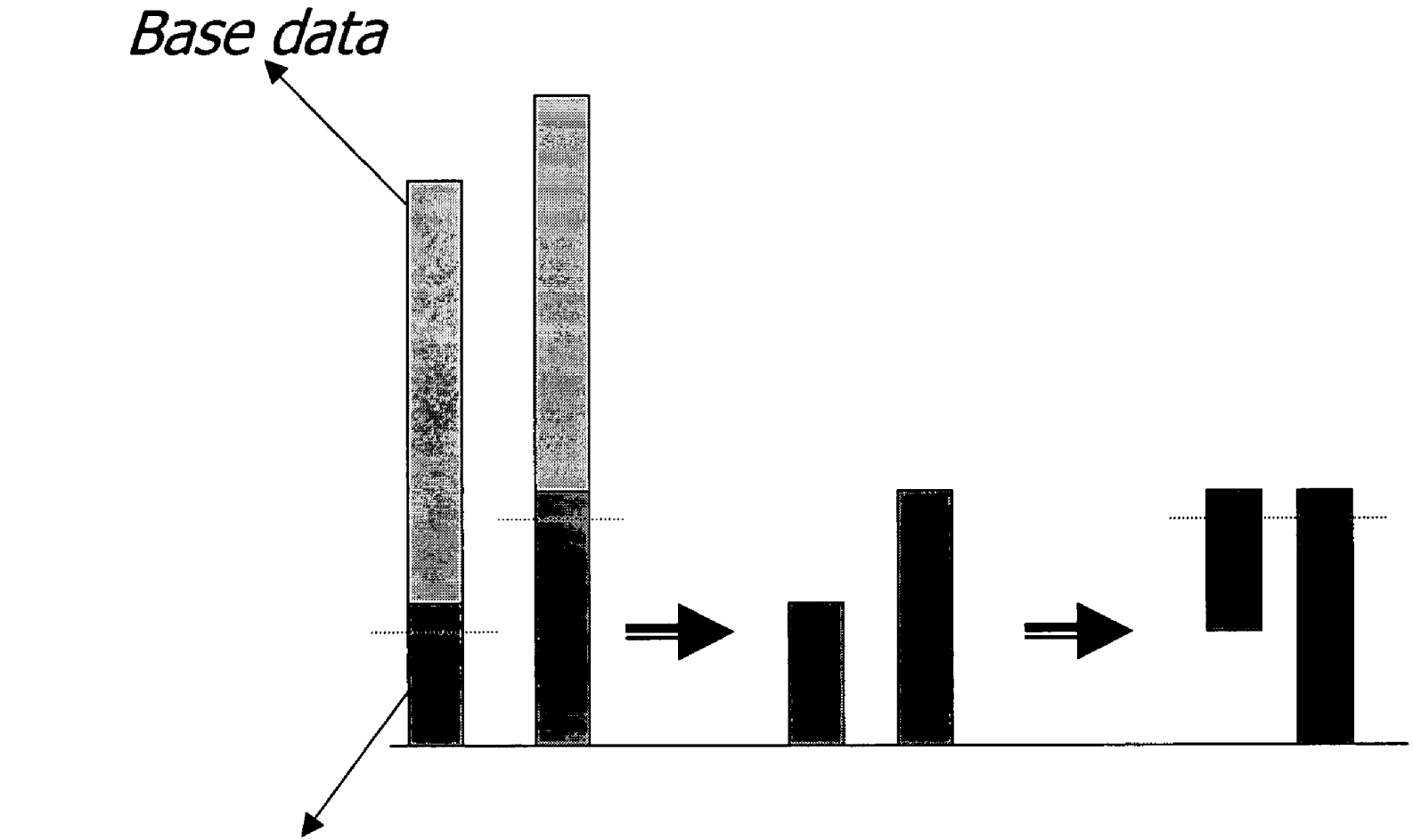
FIG. 4 is a schematic bar chart illustrating exemplary compositions of a portion of base data and enhancement data at two spectral sections or lines in embodiments consistent with the present invention.

FIG. 4 shows a schematic bar chart illustrating exemplary compositions of a portion of base data and enhancement data at two spectral sections or lines, with their height indicating the magnitude of data. In one embodiment, the upper portions of the two leftmost bars represent the base data, and the bottom ends of these upper portions are indicative of the precision reached by an AAC core coder, which codes the base data. In other words, the bottom ends of these upper portions are indicative of the precision of the quantized spectral data calculated or generated by the AAC core coder. For example, the first spectral line from the left has a precision down to a lower point than that of the second spectral line from the left. Accordingly, the base data at the first spectral line has a higher precision, as it has data that goes down to a smaller or more accurate digit. In one embodiment, the desired precision of data in a particular spectral line or band may be derived from using a psycho-acoustics model.

In addition to the base data represented by the upper portions, the lower portions of the two leftmost bars represent the residuals of audio data at those spectral lines. Still referring to FIG. 4, the enhancement data in one embodiment contain the residual audio data of the two left spectral lines, and the data may be used to increase the accuracy of sound levels or the sound effects at these two spectral lines. As noted above and in FIG. 1, the enhancement data may be obtained by subtracting the base data from the data of the audio signals.

FIG. 4 also is illustrative of an exemplary slicing process in one embodiment in which a coder may have all bands of enhancement data conceptually equalized at their maximum bit plane. Referring to FIG. 4, the enhancement data, or the lower portions of the two leftmost bars, are separated from the base data first, as shown by the two bars in the middle of FIG. 4. Thereafter, the enhancement data are conceptually equalized at their maximum bit plane, as indicated by the two rightmost bars. Accordingly, when bit-slicing the enhancement data, which may start from the top, all scalefactor bands get their maximum bit plane coded first no matter where their maximum bit plane is. In one embodiment, the overall residual, or enhancement data, may have been shaped by a psycho-acoustics model in an AAC core coder. So no matter how big or small the data is in a specific band, it has roughly the same psycho-acoustical effect as those in other scalefactor bands.

However, for spectral lines with zero quantization value in base data resulted from AAC core coding, that theory may not be entirely accurate. For example, when only a portion of enhancement data is transmitted due to bit rate limitation, the acoustic effect of coding and then decoding the enhancement data for those zero-value spectral lines first may be different from that of coding and then decoding the equalized bands by sequence. For example, a little bit of added residual for zero-quantization-value spectral lines will change the audio data of those lines from zero to non-zero, and such effect may go beyond what the effect resulted from following a psycho-acoustics model.

Figure 5:
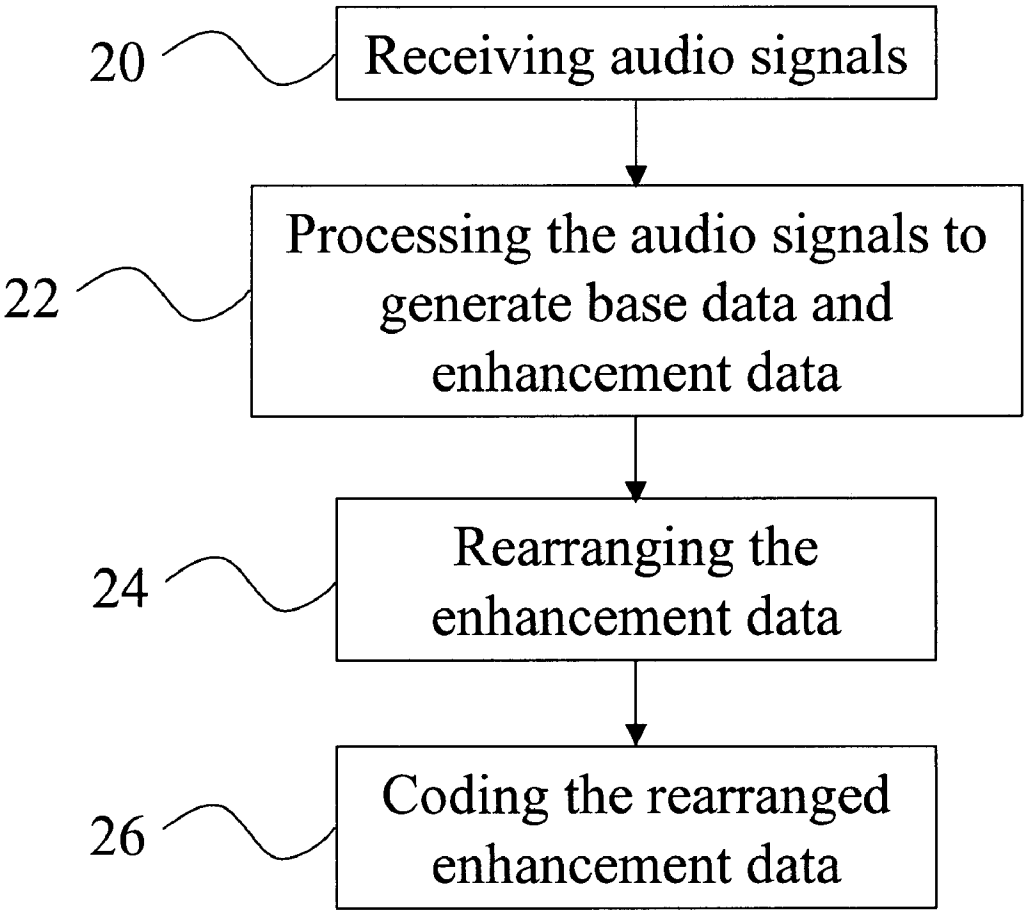
FIG. 5 is a schematic flow chart illustrative of an audio coding method in embodiments consistent with the present invention.

Therefore, in some embodiments, we may rearrange the enhancement data or the data bits of the data being coded, and the rearrangement may enhance the performance when the bit rate is low and only a portion, or the front end, of the enhancement data is transmitted and decoded. FIG. 5 shows a schematic flow chart illustrative of an audio coding method in embodiments consistent with the present invention. At step 20, audio signals are received. The audio signals can be analog or digital signals and may have audio data of one or more audio channels.

At step 22, the audio signals received are processed to generate base data and enhancement data. In one embodiment, the audio signals may be processed by a decoder, such as AAC core decoder 10 in FIG. 1. As noted above, the base data contain coded audio data representative of, and therefore capable of being decoded to generate, a portion of the audio signals. In one embodiment, the processing of the audio signals may include converting the incoming signals to frequency-domain based data and quantizing the audio data in spectral lines into quantized data. In addition, a psycho-acoustics model may determine the scale factors associated with separate bands according to the characteristics of those bands, such as the relevance, the psycho-acoustical effect, the noise tolerance, or the quality requirement of the sub-bands. Further, those scale factors may vary with different needs or applications under different coding approaches.

After obtaining the base data representative of a portion of the audio signals, the enhancement data representative of at least a part of the residual portion of the audio signals may be generated. As noted above, the enhancement data may be generated by subtracting the base data from the audio signals in one embodiment. In one embodiment, the enhancement data may cover audio data at separate spectral sections, bands, sub-bands, or lines, and, therefore, may be data represented in spectral sections. For example, the enhancement data may cover two, and usually many more, spectral sections of the audio signals.

At step 24, the enhancement data are rearranged in their order according to one or more sectional factors, such that output data may be generated from rearranged enhancement data. In one embodiment, one possible goal of rearranging step 24 is to rearrange the enhancement data so that more significant data can be placed at or near the beginning of the output data derived from rearranged enhancement data. In other words, through rearrangement, data having more significance, such as more significance in improving the audio quality, may be transmitted first whenever additional bandwidth for transmitting the output data for enhancement becomes available.

In one embodiment, sectional factors may serve as an indication of the significance, relevance, importance, quality improvement effect, or quality requirement of enhancement data at the corresponding sections. As an example, sectional factors may include the significance, such as the acoustical effect, of each section of the enhancement data to a receiving end, such as a listener, human ears, or a machine, the significance of each section of the enhancement data in improving audio quality, the existence of base data in each section, the abundance of base data in each section, and any other factors that may reflect the characteristics or effect of the audio information of the enhancement data at the corresponding sections. It is noted that this catalog of sectional factors is exemplary only. It will be appreciated by one of ordinary skill in the relevant art that it is possible to include or employ other elements as sectional factors to account for different considerations and/or meet specific needs of a particular coding approach.

As noted above, sections may mean spectral lines, spectral bands, or combinations of both. By considering sectional factors such as acoustical effect, sections having enhancement data that make a bigger difference to a receiving end, such as a listener, human ears, or a machine, may have their data moved up in order. By moving up the order of certain data, a data communication channel may transmit those data first whenever additional bandwidth becomes available, thereby improving the acoustical effect at the receiving end through first providing enhancement data that matter more than other data. For example, in one embodiment, rearranging step 24 may include up-shifting, entirely or partially, bits of enhancement data that are representative of the audio data at specific bands.

In one embodiment, each scalefactor band or sub-band may be considered as one unbreakable unit. Such band-based approach may avoid extensive modification of existing SLS reference codes. In one embodiment, the rearrangement may be designed to increase the precision of the audio information at spectral lines with zero quantized values or of spectral bands with one or more zero-quantized-value lines. Therefore, in one embodiment, sectional factors may take into account the existence of base data in each section or the abundance of base data in each section. For example, rearranging step 24 may include calculating zero-line ratios of the bands in the base data. The zero-line ratio of a band may be defined as the ratio of the number of spectral lines with zero quantization value to the total number of spectral lines in that particular band of base data. A higher zero-line ratio of a band means less base data at that particular band, and, therefore, providing enhancement data for that section or band is likely to enhance the acoustical effect to a receiving end or improve the audio quality to a listener. As noted above, a section may a be band, a sub-band, a line, or a combination of them in various embodiments consistent with the present invention. Without limiting the scope of the invention, the following will discuss an exemplary embodiment that group the data by bands.

Figure 6:
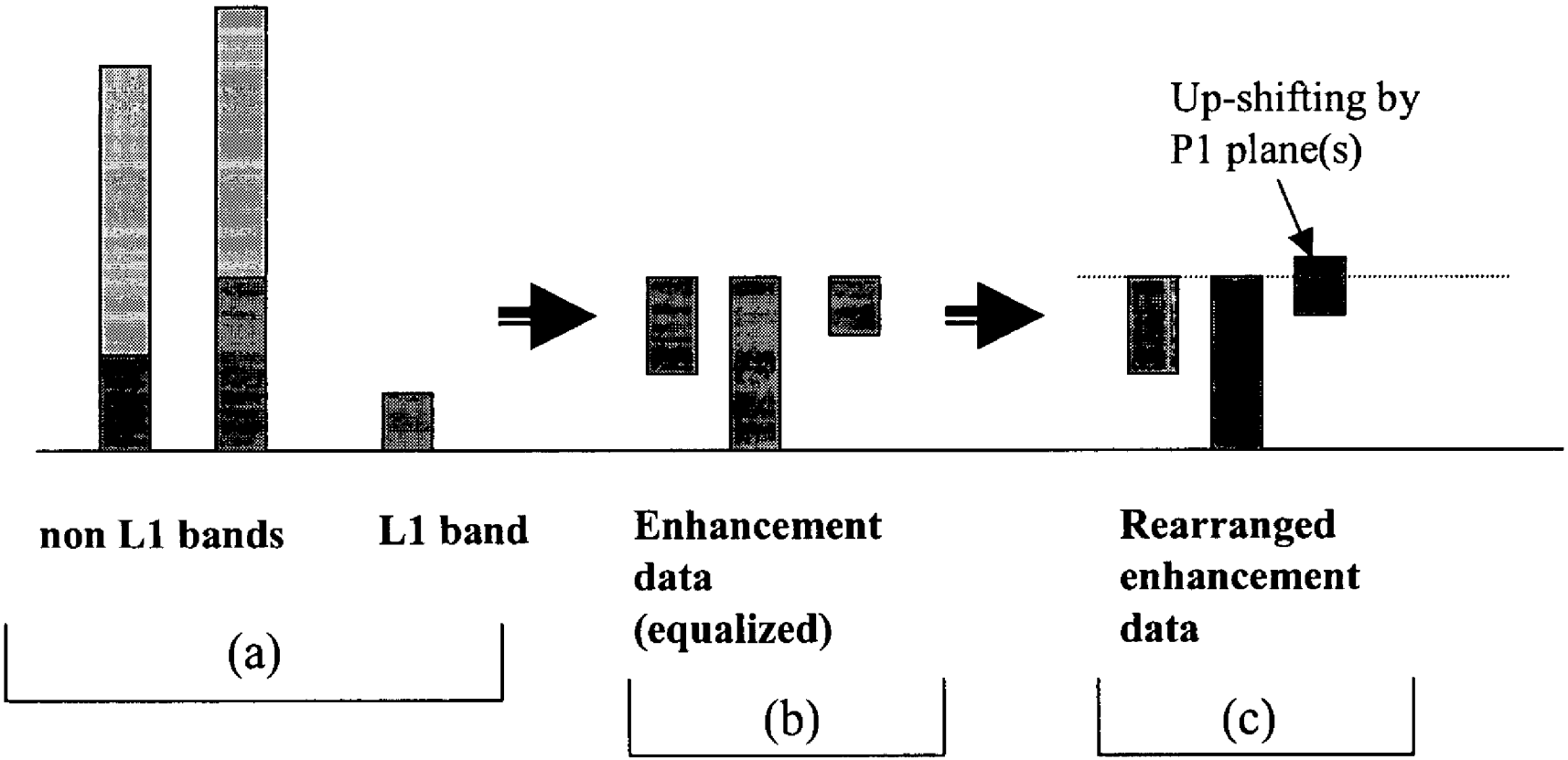
FIG. 6 is a schematic diagram illustrating the process of up-shifting the data of a band in embodiments consistent with the present invention.

In one embodiment, to rearrange the enhancement data, rearranging step 24 may include up-shifting bands by one or more planes if those bands have corresponding zero-line ratios that are higher than or equal to a prescribed "ratio bound". FIG. 6 shows a schematic diagram illustrating the process of up-shifting the data of a band to increase its priority in bit-slicing. Referring to FIG. 6, group (a) having three bars at the left represents audio data with the combination of base data and enhancement data at three separate bands. The left two bands (non-L1 bands) have been determined to have zero-line ratios not higher than nor equal to prescribed ratio bound L1. The third band (L1 band) has been determined to have a zero-line ratio higher than or equal to prescribed ratio bound L1.

Referring again to FIG. 6, group (b) illustrates one possible arrangement of enhancement data before they are coded. As shown in FIG. 6, a coder may have the data of all scalefactor bands conceptually equalized at their maximum bit plane in one embodiment. When a bit-slicing process starts, all scalefactor bands get their data at the maximum bit plane coded no matter where their maximum bit plane is. In one embodiment, the overall residual has been shaped by the psycho-acoustics model in an AAC core coder. Therefore, it may be the case that separate sections or bands have roughly the same psycho-acoustical effects. However, as noted above, for spectral lines with zero quantization values resulted from AAC core coding, the effect of providing their enhancement data first may be different. In particular, a little bit of added residual for those spectral lines means changing the data value from zero to non-zero, and its acoustical effect may go beyond what psycho-acoustics models can predict.

Therefore, in one embodiment, we may rearrange the enhancement data before they are coded. Referring again to FIG. 6, group (c) illustrates an example of rearranged enhancement data, which have the data of the L1 band up-shifted by P1 plane(s). Therefore, when the enhancement data is coded, the data of L1 band, which have been up-shifted, may be coded first. Not until its data at the highest P1 bit-planes have been coded will coding start for the data of the non-L1 bands along with the rest bit planes of the data of the L-bands. In other words, this may be equivalent to up-shifting the data of all L1-bands by P1 planes to increase their priority in bit-slicing. Accordingly, a decoder receiving those data may follow a similar procedure, which may decode the data from those up-shifted L1 band or bands first.

Figure 7:
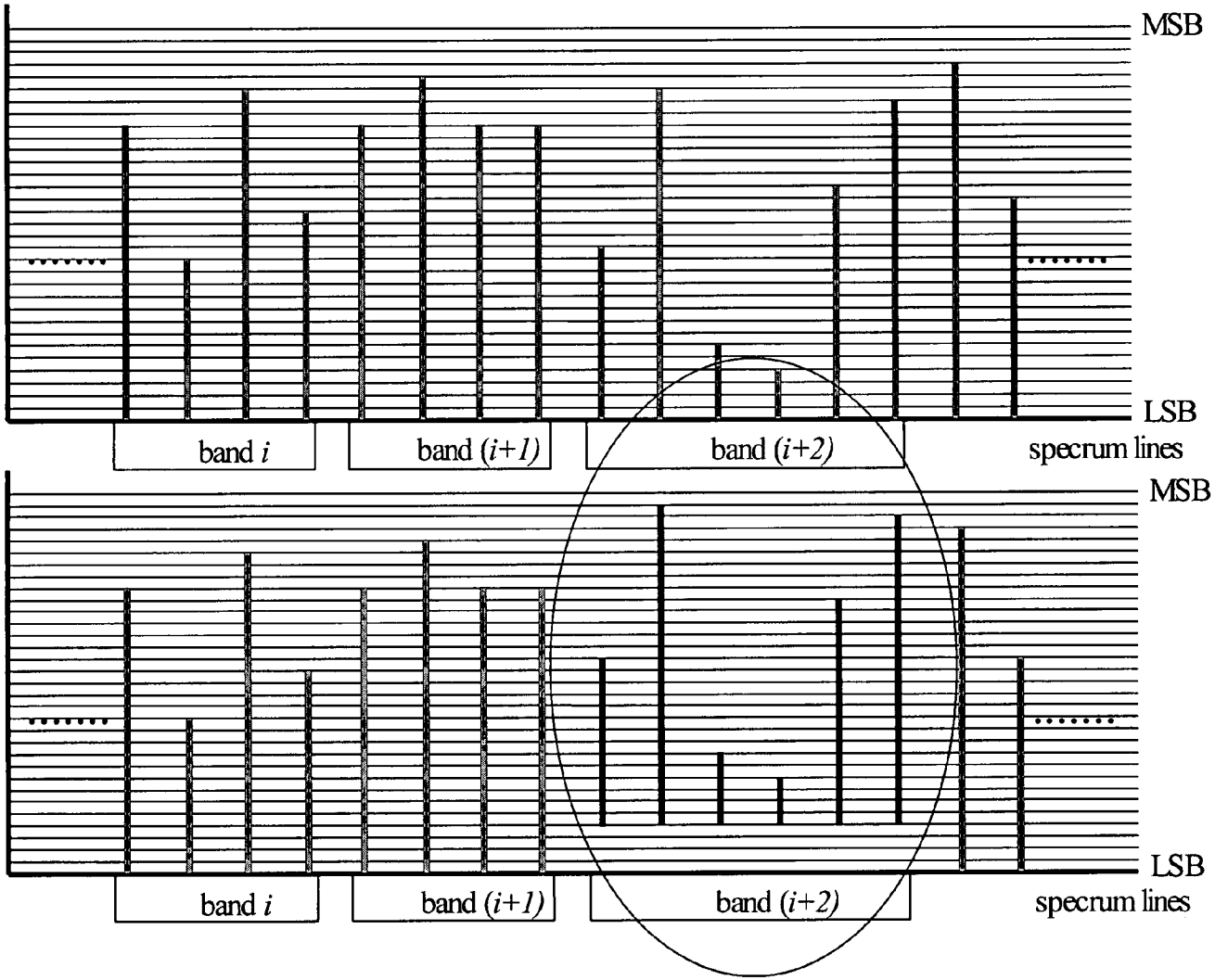
FIG. 7 shows schematic diagrams illustrating the plane-shifting of enhancement data in embodiments consistent with the present invention.

FIG. 7 shows schematic diagrams illustrating the plane-shifting of enhancement data at a certain band. Referring to FIG. 7, the upper diagram is representative of enhancement data at a portion of the frequency spectrum. After it is determined that a particular band or sub-band has a zero-line ratio higher than or equal to a prescribed ratio bound L1, the data of all of the spectral lines in that band or sub-band may be up-shifted by P1 planes. Referring again to FIG. 7, the lower diagram illustrates the up-shifting of the data of all spectral lines at band (i+2) by P1 planes. After the enhancement data are rearranged, portions of the enhancement data in the up-shifted band may take priority during bit-slicing, thereby allowing more significant data to be coded first.

Referring again to FIG. 6, after the enhancement data rearranging step 24, the rearranged data may be coded at step 26. In one embodiment, the coding processing may include quantizing or bit-slicing rearranged enhancement data, which may have or have not been equalized at their maximum plane before the rearrangement. Output enhancement data may be generated from coding step 26. In particular, a bit-plane Golomb known to skilled artisans may be applied in one embodiment.

In one embodiment, an exemplary algorithm for bit plane shifting may include the following:

```
ii = 0;
    noisefloor_reached = 0;
    while(!noise_floor_reached) {
        .
        .   for (s=0;s<total_sfb;s++) {
            iii = ii - L + shift[s];
                if(iii>=0) {            if((p_bpc_maxbitplane[s])>=iii) {
                    int bit_plane = p_bpc_maxbitplane[s] - iii;
                            int lazy_plane = p_bpc_L[s] - iii + 1;
                                .
                                .
                                .
                        }
                }
        } /*        for (s=0;s<total_sfb;s++)*/
            ii++;
    } /* while*/
```

In another embodiment, two or more prescribed ratio bounds may be set, and bands having zero-line ratios higher than or equal to a second or third ratio bound may have their data up-shifted for more planes. For example, if L denotes a prescribed ratio bound and P denotes the number of planes to be shifted, a two-tier system may be derived from employing L1 and P1 as illustrated above. Under that system, a band having a zero-line ratio exceeding or equal to L1 will have its data up-shifted by P1 plane(s). Alternatively, under a multiple-tier system with (L1, P1), (L2, P2), . . . (Ln, Pn), a band having a zero-line ratio exceeding or equal to L1 (L1 bands), but not L2 and L3, will have its data up-shifted by P1 plane(s). Accordingly, a band having a zero-line ratio exceeding or equal to L2, but not L3, will have its data up-shifted by P2 plane(s), and a band having a zero-line ratio exceeding or equal to Ln will have its data up-shifted by Pn plane(s).

In one exemplary embodiment, separate sets of two-tier-system parameters can be used for audio data decoded at different AAC core rates.

L1=1, P1=1 for an AAC core rate of 32 kbps

L1=0.5, P1=3 for an AAC core rate of 64 kbps

L1=0.125, P1=5 for an AAC core rate of 128 kbps

In one embodiment, as the bit rate of AAC core increases, there will be less number of zero-value quantized spectral lines, as well as less space for improvement from the addition of enhancement data. Eventually, the effect of rearranging enhancement data may be limited. Therefore, in embodiments with high AAC core rates, ratio bound L1 may reach zero. With a zero ratio bound, all scalefactor bands are treated equally, and the plane shifting number P1 no longer matters.

Figure 8:
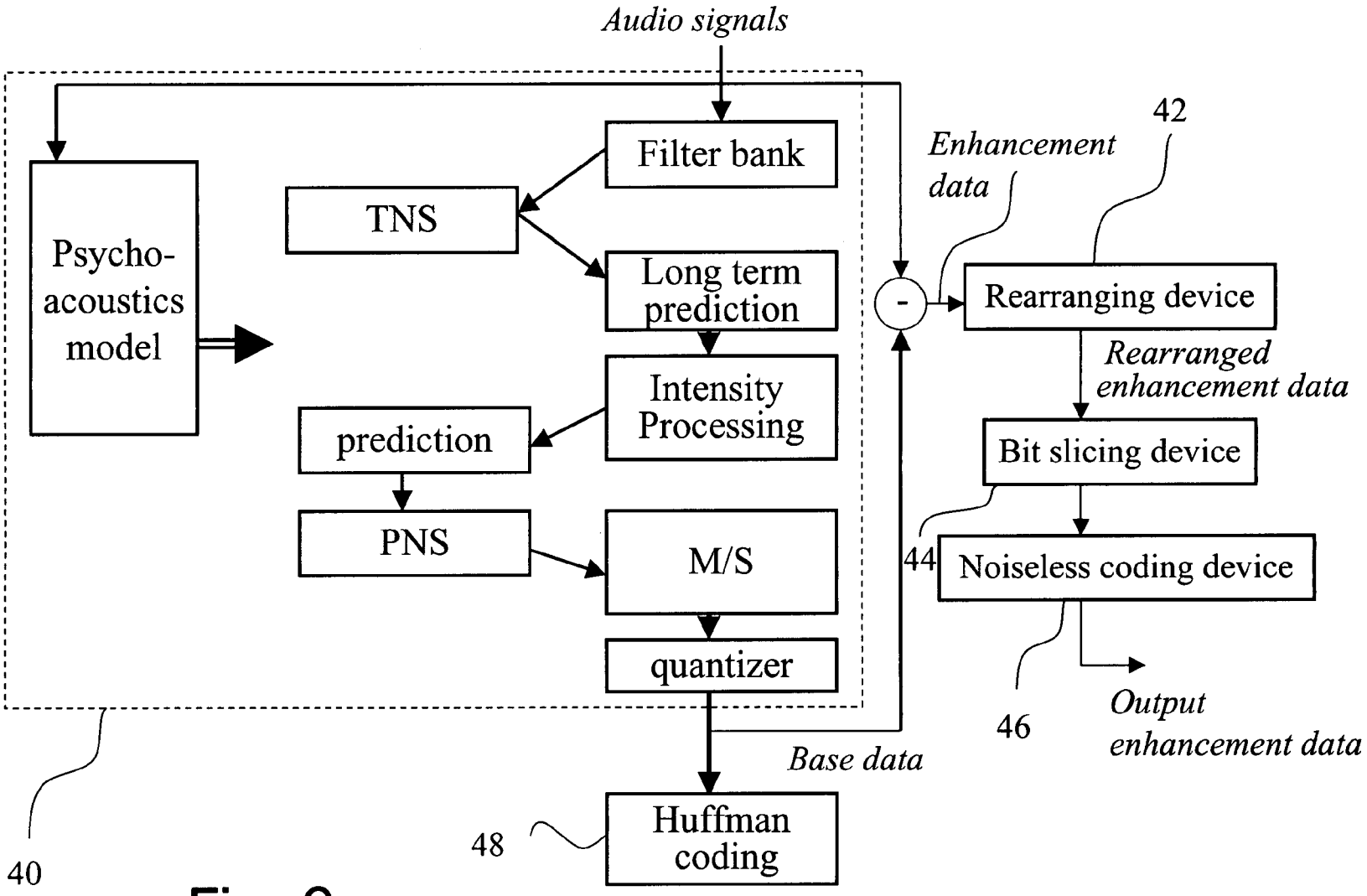
FIG. 8 is a schematic block diagram of an audio coding device in embodiments consistent with the present invention.

FIG. 8 shows a schematic block diagram of an audio coding device in embodiments consistent with the present invention. Referring to FIG. 8, the device may include audio coder 40 and rearranging device 42 in one embodiment. Depending on the design, the audio coding device may also include bit-slicing device 44 and noiseless coding device 46. Audio coder 40 receives audio signals and generates from the audio signals base data and enhancement data. As noted above in one embodiment, the base data may contain data capable of being decoded to generate a portion of the audio signals. And the enhancement data may contain data representative of at least a part of the residual portion of the audio signals. In one embodiment, the enhancement data cover audio data at two or more spectral sections.

Audio coder 40 may be an AAC core coder in one embodiment, and may employ a psycho-acoustics model during audio coding. Further, in one embodiment, audio coder may include various components diagramed in and coupled as shown in FIG. 8, including a temporal noise shaping ("TNS") device, a filter bank, a long-term prediction device, an intensity processing device, a prediction device, a perceptual noise sensitivity ("PNS") processing device, a mid/side ("M/S") stereo processing device, and a quantizer. Exemplary descriptions of those devices may be found in U.S. Pat. No. 6,529,604 to Park et al. In addition, a Huffman coding device 48 may be used to Huffman-code the base data generated by audio coder 40.

Referring again to FIG. 8, rearranging device 42 is coupled to audio coder 40 to receive enhancement data, which may be derived from one or more residual portions of the audio signals after audio coder 40 generates the base data. Rearranging device 42 rearranges the enhancement data according to sectional factors to allow output enhancement data to be generated from rearranged enhancement data. In one embodiment, bit-slicing device 44 may bit-slice the rearranged enhancement data to obtain the data in a descending sequence of bit planes. Noiseless coding device 46 may further process the bit-sliced data to generate the output enhancement data, which may be combined with the Huffman-coded base data by a multiplexor and transmitted in part or in its entirety through communication networks.

Figure 9:
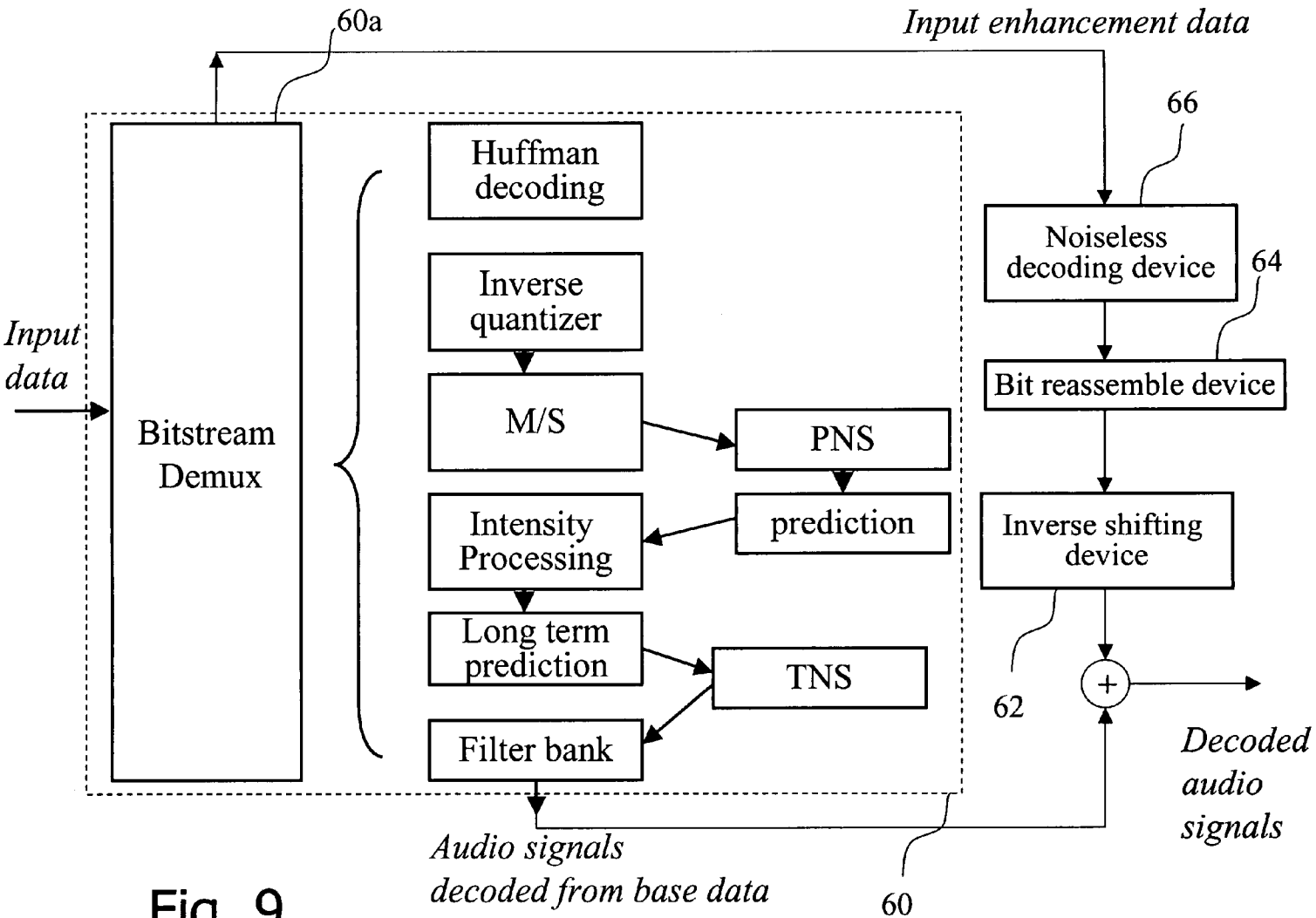
FIG. 9 is a schematic block diagram of an audio decoding device in embodiments consistent with the present invention.

FIG. 9 shows a schematic block diagram of an audio decoding device in embodiments consistent with the present invention. Referring to FIG. 9, the device, which may be placed at the receiving end of a communication work, may include audio decoder 60 and inverse shifting device 62 in one embodiment. Depending on the design, the audio decoding device may also include bit-reassemble device 64 and noiseless decoding device 66. Audio decoder 60 receives input data, which may contain base data, and, in many cases, portions of or complete enhancement data. Audio decoder may include a bitstream de-multiplexor 60*a* for separating the enhancement data, if any, from the base data for separate decoding operations. Audio decoder 60 may be designed based on the type of coding technique that the input data use. In one embodiment, audio decoder 60 may include various components diagramed in and coupled as shown in FIG. 9, including a Huffman decoding device, an inverse quantizer, a mid/side ("M/S") stereo processing device, a PNS processing device, a prediction processing device, an intensity processing device, a long-term prediction device, a TNS device, and a filter bank. As noted above, certain exemplary descriptions of those devices may be found in U.S. Pat. No. 6,529,604 to Park et al.

Referring again to FIG. 9, inverse-shifting device 62 is coupled to audio decoder 60 to receive decodable enhancement data derived from the input data. Inverse-shifting device 62 is designed to reverse the process of rearranging device 42 in FIG. 8 to obtain audio data. Accordingly, noiseless decoding device 66 and bit reassemble device 64 may process the input enhancement data before inverse-shifting device 62 processes the input enhancement data. After processing the input enhancement data, inverse-shifting device 62 generates partial audio signals, which are then combined with audio signals decoded from the base data to become the decoded audio signals for a listener.

Without limiting the scope of the invention, an experiment previously done has demonstrated the effect of proposed approaches. In one embodiment, six sound samples are provided in three pairs: a 32 k pair, a 64 k pair, and a 128 k pair, each having the same AAC-core bit rate. The two samples in each pair differ in the way their enhancement data are coded. Group A of samples have the highest P1 bit planes of their L1-bands coded and decoded, while leaving out all non-L1-bands. In contrast, Group B has the highest P1 bit planes of its non-L1-bands coded and decoded, while leaving out all L1-bands. A subjective test of listeners suggested significant improvement of sound quality with the enhancement data of each sample that have the highest P1 bit planes of their L1-bands coded and decoded. Table 1 shows results from a subjective test under separate AAC-core bit rates, described in MUSHRA scale.

TABLE 1

| | 32 kbps | 64 kbps | 128 kbps |
|---|---|---|---|
| Group A | 2 | 1.5 | 1 |
| Group B | 0.2 | 0.2 | 0 |

Even under a subjective test without exact measurements, the result suggested significant sound-improving effects of first providing, or coding, the residual in L1-bands, when compared with that of first providing, or coding, the non-L1-bands.

The foregoing disclosure of the preferred embodiments of the present invention have been presented for purposes of illustration and description. They are not intended to be exhaustive or to limit the invention to the precise forms disclosed. Many variations and modifications of the embodiments described herein will be apparent to one of ordinary skill in the art in light of the above disclosure. The scope of the invention is to be defined by the claims appended hereto and their equivalents.

Further, in describing representative embodiments of the present invention, the specification may have presented coding methods or processes consistent with the present invention as a particular sequence of steps. However, to the extent that a method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method of the present invention should not be limited to the performance of their steps in the order written, and one skilled in the art can readily appreciate that the sequences may be varied and still remain within the spirit and scope of the present invention.

We claim:

1. An audio coding method comprising:

receiving audio signals;

processing the audio signals to generate base data and enhancement data, the base data containing data capable of being decoded to generate a portion of the audio signals, the enhancement data covering at least two spectral sections of data representative of a residual portion of the audio signals, wherein the base data include a plurality of bands each having at least one spectral line for storing quantized audio data, and each of the spectral sections of the enhancement data has at least one spectral band having at least one spectral line;

calculating zero-line ratios of the bands in the base data, wherein a zero-line ratio of a band is the ratio of the number of spectral lines with zero quantized value to the number of spectral lines in the band;

coding the enhancement data and up-shifting the band by at least one plane if a corresponding zero-line ratio of the band is higher than or equal to a prescribed ratio bound, wherein the number of the at least one plane that the band is up-shifted varies with the range of the corresponding zero-line ratio; and rearranging the enhancement data according to sectional factors associated with the spectral sections to allow output data to be generated from rearranged enhancement data.

2. The method of claim 1, wherein the enhancement data are scalable data.

3. The method of claim 1, wherein each of the sectional factors associated with a corresponding section includes at least one of the significance of the enhancement data of the section to a receiving end, the significance of the enhancement data of the section in improving audio quality, the existence of base data in the section, and the abundance of the base data in the section.

4. The method of claim 1, wherein up-shifting the band comprises up-shifting the band to increase a bit-slicing priority of the band in bit-slicing.

5. The method of claim 1, further comprising equalizing the spectral sections the enhancement data at their maximum bit plane before rearranging the enhancement data.

6. The method of claim 1, further comprising coding the rearranged enhancement data by bit-slicing the rearranged enhancement data.

7. A bit rearranging process for audio coding, the process comprising:

receiving base data and enhancement data representative of audio signals, the base data containing data capable of being decoded to generate a portion of the audio signals, the enhancement data covering at least two spectral sections of data representative of a residual portion of the audio signals, wherein the base data includes a plurality of bands each having at least one spectral line for storing quantized audio data, and each of the spectral sections of the enhancement data has at least one spectral band having at least one spectral line;

calculating zero-line ratios of the base data of the sections, a zero-line ratio of a section being the ratio of the number of spectral lines with zero quantized value to the number of spectral lines in that section; and rearranging enhancement data by up-shifting the section of the enhancement data by at least one plane if the corresponding zero-line ratio is higher than or equal to a prescribed ratio bound, wherein the number of the at least one plane that the section is up-shifted varies with the range of the corresponding zero-line ratio.

8. The method of claim 7, further comprising coding rearranged enhancement data by bit-slicing the rearranged enhancement data, wherein up-shifting the section comprises up-shifting the section to increase a bit-slicing priority of the section in bit-slicing.

9. The method of claim 7, further comprising equalizing the sections of the enhancement data at their maximum bit plane before rearranging the enhancement data.

10. A method of determining band significance of enhancement data derived from audio signals, the method comprising:

calculating zero-line ratios of bands of base data derived from the audio signals, a zero-line ratio of a band being the ratio of the number of lines with zero quantized value to the number of lines in that band;

deriving a band significance of the band of the enhancement data according to the corresponding zero-line ratios of the associated bands; and rearranging enhancement data by up-shifting the band of the enhancement data by at least one plane if the corresponding zero-line ratio is higher than or equal to a prescribed ratio bound, wherein the number of the at least one plane that the section is up-shifted varies with the range of the corresponding zero-line ratio.

11. The method of claim 10, wherein the base data contain data capable of being decoded to generate a portion of the audio signals, and the enhancement data cover at least two spectral bands of a residual portion of the audio signals.

12. The method of claim 10, further comprising coding rearranged enhancement data by bit-slicing the rearranged enhancement data, wherein up-shifting the section comprises up-shifting the section to increase a bit-slicing priority of the section in bit-slicing.

13. The method of claim 10, wherein the number of planes that the band is up-shifted varies with the range of the corresponding zero-line ratio.

14. The method of claim 10, further comprising equalizing the bands of the enhancement data at their maximum bit plane before rearranging the enhancement data.

15. An audio coding device comprising:

an audio coder for receiving audio signals and generating base data and enhancement data, the base data containing data capable of being decoded to generate a portion of the audio signals, the enhancement data covering at least two spectral sections of data representative of a residual portion of the audio signals, wherein the base data include a plurality of bands each having at least one spectral line for storing quantized audio data, and each of the spectral sections of the enhancement data has at least one spectral band having at least one spectral line; and a rearranging device coupled to the audio coder for rearranging the enhancement data according to sectional factors of the spectral sections to allow output data to be generated from rearranged enhancement data, wherein the rearranging device is configured to calculate zero-line ratios of the bands in the base data, wherein a zero-line ratio of a band is the ratio of the number of spectral lines with zero quantized value to the number of spectral lines in the band, and rearrange the enhancement data by up-shifting the band of the enhancement data by at least one plane if the corresponding zero-line ratio is higher than or equal to a prescribed ratio bound, and wherein the number of the at least one plane that the section is up-shifted varies with the range of the corresponding zero-line ratio.

16. The device of claim 15, wherein each of the sectional factors associated with a corresponding section includes at least one of: the significance of the enhancement data of the section to a receiving end, the significance of the enhancement data of the section in improving audio quality, the existence of base data in the section, and the abundance of the base data in the section.

17. The device of claim 16, further comprising a bit-slicing device for coding the rearranged enhancement data by bit-slicing the rearranged enhancement data.

* * * * *